US006105190A

United States Patent [19]

Shiao

[11] Patent Number: 6,105,190

[45] Date of Patent: Aug. 22, 2000

[54] DRIVING TOOL WITH DETACHABLE TELESCOPIC RETRIEVER

[76] Inventor: Hsuan-Sen Shiao, No. 15-1, Lane 369, Min-Chuan Rd., Taichung City, Taiwan

[21] Appl. No.: 09/379,979

[22] Filed: Aug. 24, 1999

[51] Int. Cl.[7] ..... B25B 15/00

[52] U.S. Cl. ..... 7/165

[58] Field of Search ..... 7/138, 165, 170; 81/451

[56] References Cited

U.S. PATENT DOCUMENTS

| | | | |
|---|---|---|---|
| 5,381,319 | 1/1995 | Shiao | 81/439 |
| 5,868,048 | 2/1999 | Cassutti et al. | 81/439 |
| 5,878,637 | 3/1999 | Liu | 81/451 |
| 5,896,606 | 4/1999 | Huang | 7/165 |
| 5,901,622 | 5/1999 | Sweeny | 81/439 |

*Primary Examiner*—Timothy V. Eley
*Assistant Examiner*—Dung Van Nguyen
*Attorney, Agent, or Firm*—Sheridan Ross P.C.

[57] ABSTRACT

A driving tool includes an elongate hollow handle formed with a longitudinally extending receiving chamber and an open rear end, a tubular shank mounted securely on a front end of the handle and confining an axial bore communicated with the receiving chamber, a telescopic retriever disposed in the receiving chamber, a rear cap mounted removably on the rear end of the handle, and a spring-loaded retaining unit mounted on the shank. The axial bore has a cross-section smaller than that of the receiving chamber. The shank has an open drive end adapted for receiving removably a tool bit. The telescopic retriever has a front end extendible into the axial bore to reach the drive and, and provided with a magnet member. The front end of the telescopic retriever is extendible forwardly to project from the drive end. The retaining unit is extendible radially into the axial bore so as to be adapted to retain removably the tool bit at the drive end.

5 Claims, 5 Drawing Sheets

DRIVING TOOL WITH DETACHABLE TELESCOPIC RETRIEVER

BACKGROUND OF THE INVENTION

1. Field of the Invention

This invention relates to a driving tool, more particularly to a driving tool with a detachable telescopic retriever that can be extended to possess a relatively long length for retrieving a fastener disposed in a deep hole.

2. Description of the Related Art U.S. Pat. No. 5,878,637 discloses a driving tool having a tubular shank and a handle secured to one end of the shank for rotating the same. The shank has another end formed with an engaging opening adapted for receiving a tool bit. A telescopic retriever is received in the shank, and has one end secured to the handle and the other end provided with a magnet member that is adapted to attract the tool bit for retaining the tool bit at the engaging opening. The telescopic retriever can be extended to allow extension of the magnet member outward of the shank to reach a fastener disposed in a deep hole.

However, the above-described driving tool is found to have the following drawbacks:

1. Since a tool bit is to be retained in the engaging opening of the shank, the axial bore of the shank is typically designed to have a diameter smaller than that of the engaging opening. As the telescopic retriever extends into the shank, the diameter of an outermost tube member of the telescopic retriever must be smaller than the cross-section of the axial bore of the shank. Therefore, the entire length of the telescopic retriever after extension is severely limited.

2. Because the telescopic retriever is secured to the handle, the telescopic retriever cannot be detached from the driving tool for individual use.

3. Since the tool bit is retained on the shank by the magnet member, when the tool bit is used for driving a fastener mounted on a magnetically sensitive object, such as an electronic component of a computer, the magnetic field generated by the magnet member can damage the electronic component.

SUMMARY OF THE INVENTION

Therefore, the object of the present invention is to provide a driving tool with a detachable telescopic retriever which can be used separately and which can be extended for a relatively long length to retrieve a fastener that is disposed in a deep hole.

Accordingly, the driving tool according to the present invention includes an elongate hollow handle, a tubular shank, a telescopic retriever, a rear cap, and a spring-loaded retaining unit. The handle is formed with a longitudinally extending receiving chamber, and has a front end and an open rear end. The shank is mounted securely on the front end of the handle, and confines an axial bore with a cross-section smaller than that of the receiving chamber. The shank has an open mounting end which is secured to the front end of the handle and which is communicated with the receiving chamber, and an open drive end that is opposite to the mounting end and that is adapted for receiving removably a tool bit. The telescopic retriever is disposed in the receiving chamber, and has a front end which is extendible into the axial bore of the shank to reach the drive end. The front end of the telescopic retriever is provided with a magnet member adapted for magnetic attraction with the tool bit. The front end of the telescopic retriever is extendible forwardly to project from the drive end of the shank when the tool bit is removed from the drive end. The rear cap is mounted removably on the rear end of the handle for retaining detachably the telescopic retriever in the receiving chamber. The spring-loaded retaining unit is mounted on the drive end of the shank, and is extendible radially into the axial bore of the shank so as to be adapted to retain removably the tool bit at the drive end of the shank.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
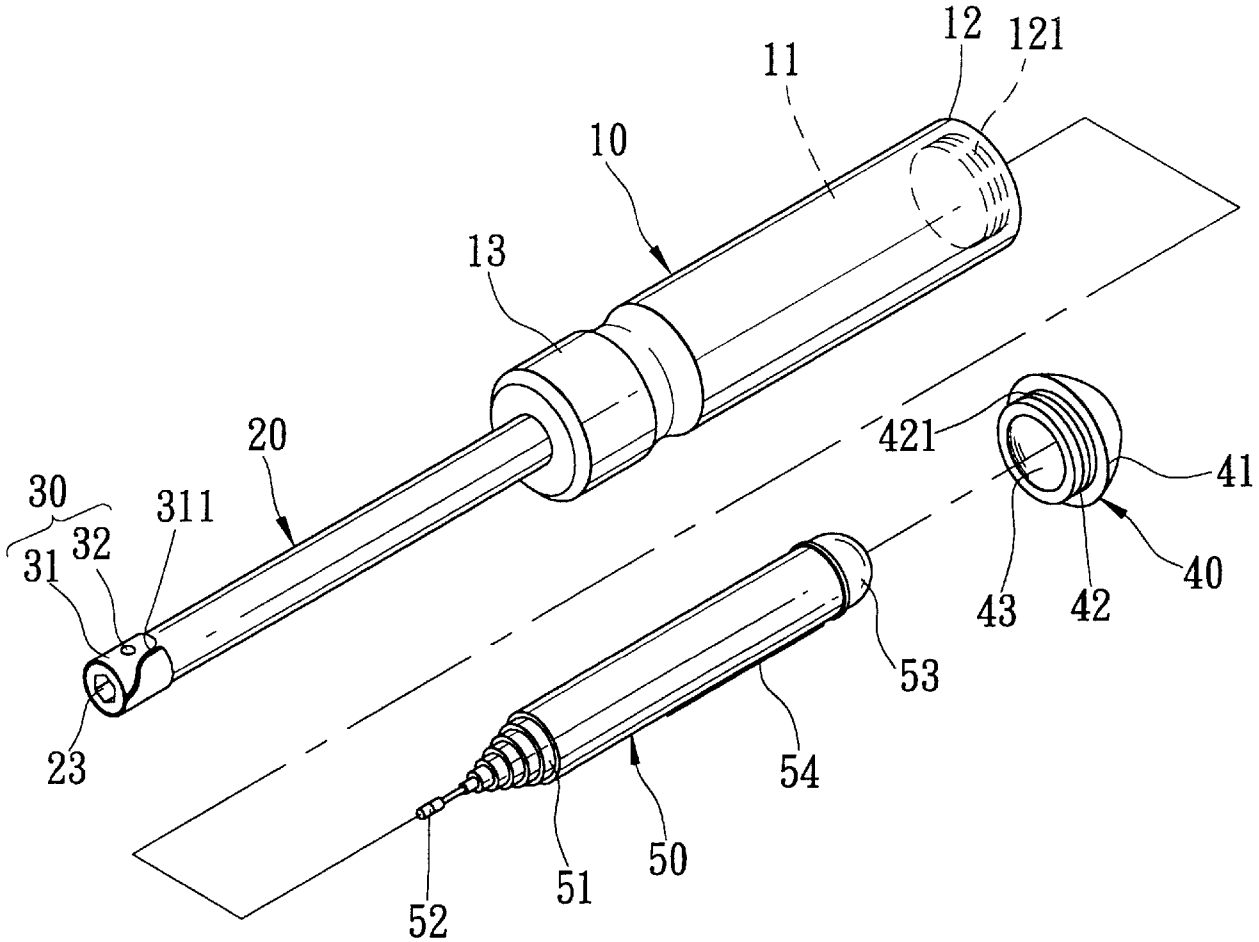
FIG. 1 is an exploded perspective view of a preferred embodiment of a driving tool according to the present invention.
Figure 2:
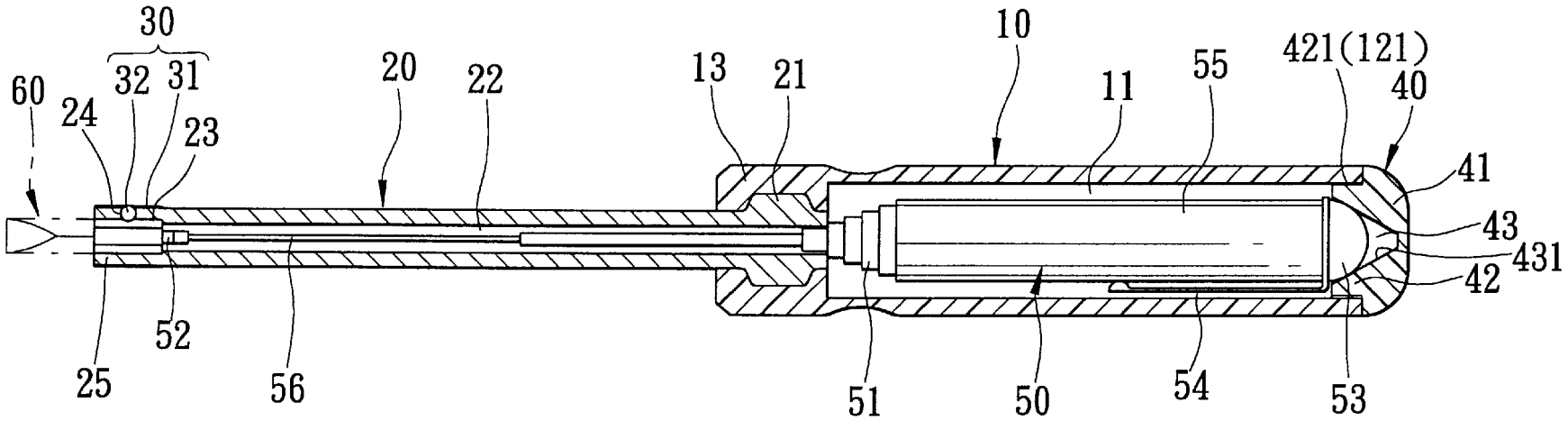
FIG. 2 is a longitudinal sectional view of the preferred embodiment.

Referring to FIGS. 1 and 2, the preferred embodiment of the driving tool according to the present invention is shown to include an elongate hollow handle 10, a tubular shank 20, a rear cap 40, a telescopic retriever 50, and a spring-loaded retaining unit 30.

The handle 10 is formed with a longitudinally extending receiving chamber 11, and has a front end 13 and an open rear end 12 formed with an internal screw thread 121.

The shank 20 has an open mounting end 21 that extends into and that is mounted fixedly and securely on the front end 13 of the handle 10, and an open drive end 25 that is opposite to the mounting end 21. The shank 20 confines an axial bore 22 which is formed through the mounting end 21 and the drive end 25 for communicating with the receiving chamber 11 and which has a cross-section smaller than that of the receiving chamber 11. The drive end 25 has an engaging hole 23 with a hexagonal cross-section adapted for receiving removably a tool bit 60. The drive end 25 is formed with a radial retaining hole 24 which converges in a radial inward direction.

The retaining unit 30 includes a ball member 32 received in the retaining hole 24, and a resilient clasp 31 sleeved on the drive end 25 of the shank 20. The clasp 31 is formed with a slit 311 that imparts resilience thereto such that the clasp 31 urges the ball member 32 to extend radially into the engaging hole 24 to abut against the tool bit 60 for retaining removably the tool bit 60 in the engaging hole 23.

The telescopic retriever 50 is received in the receiving chamber 11 via the open rear end 12 of the handle 10. The telescopic retriever 50 includes a plurality of co-axial tube members 51 with different diameters. The tube members 51 are sleeved on one another, and includes a plurality of inner tube members which have diameters not greater than the cross-section of the axial bore 22 of the shank 20 and which are extendible into the axial bore 22, and a plurality of outer tube members which have diameters greater than the cross-section of the axial bore 22 and which are retained in the receiving chamber 11. In other words, the axial bore 22 of the shank 20 has a cross-section smaller than the diameter of at least the outermost tube member 55 such that the rear end 21 of the shank 20 abuts against one of the tube members 51. A magnet member 52 is provided on a front end of the innermost tube member 56. The outermost tube member 55 has a rounded rear end 53, and an outer surface provided with a clip 54.

The rear cap 40 has a head portion 41 and an annular rim portion 42 which extends forwardly from the head portion 41 and which is formed with an external screw thread 421 for engaging the internal screw thread 121 on the rear end 12 of the handle 10 so as to close the rear end 12. The rear cap 40 is further formed with a recess 43 that confronts the receiving chamber 11 of the handle 10 and that converges gradually and rearwardly. The rounded rear end 53 of the telescopic retriever 50 abuts against a surrounding wall 431 of the recess 43 to position the telescopic retriever 50 in the receiving chamber 11.

In use, as shown in FIG. 2, the telescopic retriever 50 is disposed in the receiving chamber 11, allowing the inner ones of the tube members 51 with the smaller diameters to extend into the axial bore 22 and permit the magnet member 52 to reach the engaging hole 23. The tool bit 60 is inserted into the engaging hole 23, and is retained thereat by the ball member 32 and by means of the magnetic attraction force of the magnet member 52.

Figure 3:
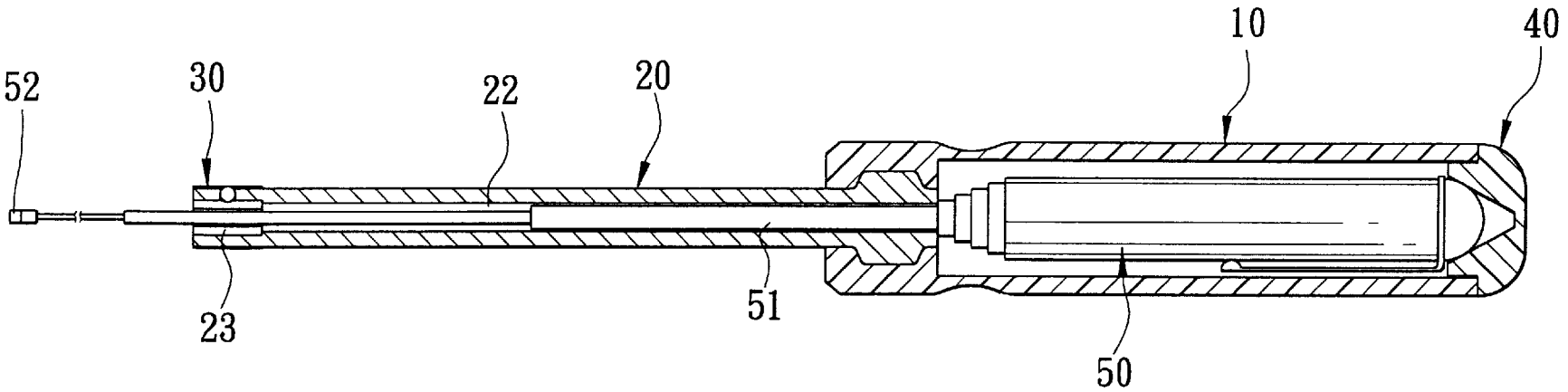
FIG. 3 is another longitudinal sectional view of the preferred embodiment, where a telescopic retriever is extended to project from a shank of the driving tool.

Referring to FIG. 3, when the tool bit 60 is removed from the drive end 25 of the shank 20, the telescopic retriever 50 can be pulled forwardly and outwardly via the engaging hole 23, due to the magnetic attraction force of the magnet member 52, thereby stretching the inner ones of the tube members 50. The driving tool can thus be used for retrieving fasteners disposed in a deep hole or slot.

Figure 4:
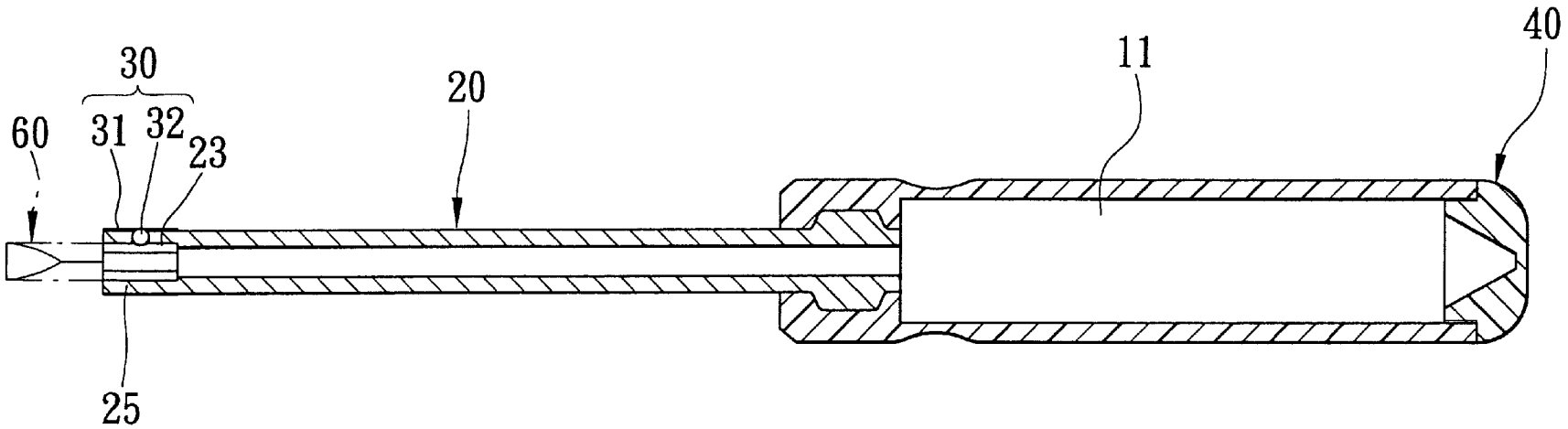
FIG. 4 is still another longitudinal sectional view of the preferred embodiment, where the telescopic retriever is detached therefrom.

Referring to FIG. 4, when the driving tool is to be used for driving fasteners in a computer, the telescopic retriever 50 can be easily removed from the receiving chamber 11 after removing the rear cap 40 from the rear end 12 of the handle 10. At this time, the tool bit 60 can still be retained at the drive end 25 of the shank 20 by means of the ball member 32 and the clasp 31 to prevent untimely removal thereof from the shank 20. Accordingly, also referring to FIG. 2, after removal of the telescopic retriever 50, the inner ones of the tube members 51 can be retracted into the outer ones of the tube members 51 with the larger diameters to reduce the length of the telescopic retriever 50. Thereafter, the telescopic retriever 50 can be placed once again in the receiving chamber 11, and the rear cap 40 is mounted once more on the handle 10. At this time, the magnet member 52 is kept in the receiving chamber 11 away from the tool bit 60 so as not to affect adversely the electronic components of the computer.

Figure 5:
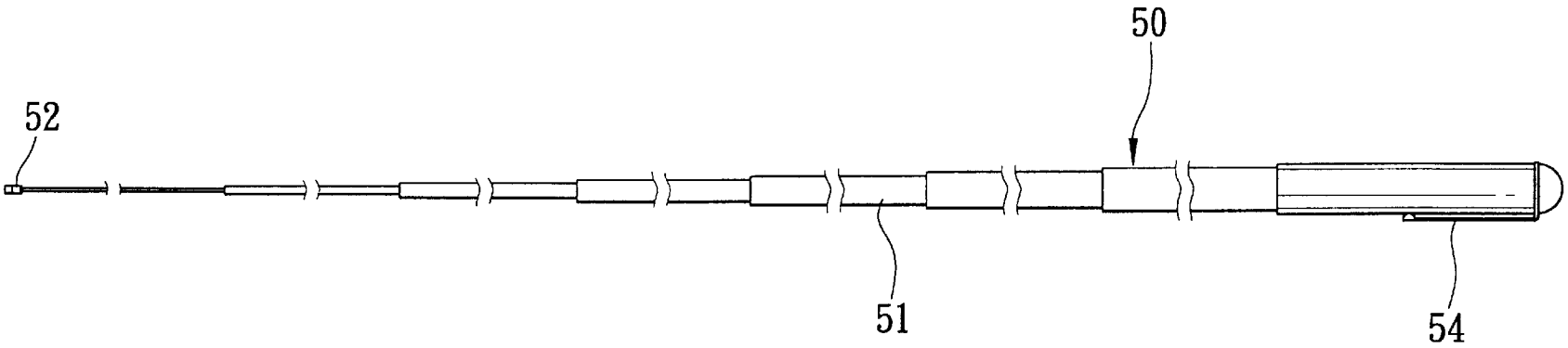
FIG. 5 is a schematic view showing the telescopic retriever when in a state for individual use.

Referring to FIG. 5, after removal from the receiving chamber 11, the telescopic retriever 50 can be used individually. The tube members 51 can be stretched to extend the length of the telescopic retriever 50 for retrieving fasteners disposed in a very deep hole.

Referring once more to FIG. 2, when the telescopic retriever 50 is received in the receiving chamber 11, the outer ones of the tube members 51 can be retracted into one another, while the inner ones of the tube members 51 can be kept in a stretched state. The telescopic retriever 50 is then placed in the receiving chamber 11 to permit the inner ones of the tube members 51 to extend into the axial bore 22 such that an outer one of the tube members 51 abuts against the rear end 21 of the shank 20.

It has thus been shown that the telescopic retriever 50 of the driving tool of the present invention can be detached from the handle 10 so as not to impart a magnetic property to the driving tool when circumstances warrant the same, and to permit individual use of the telescopic retriever 50. In addition, the telescopic retriever 50 can be extended by a relatively long length when used individually.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A driving tool comprising:

an elongate hollow handle formed with a longitudinally extending receiving chamber, said handle having a front end and an open rear end;

a tubular shank mounted securely on said front end of said handle, said shank confining an axial bore which has a cross-section smaller than that of said receiving chamber, said shank having an open mounting end which is secured to said front end of said handle and which is communicated with said receiving chamber, and an open drive end that is opposite to said mounting end and that is adapted for receiving removably a tool bit;

a telescopic retriever disposed in said receiving chamber and having a front end which is extendible into said axial bore of said shank to reach said drive end, said front end of said telescopic retriever being provided with a magnet member adapted for magnetic attraction with the tool bit, said front end of said telescopic retriever being extendible forwardly to project from said drive end of said shank when the tool bit is removed from said drive end;

a rear cap mounted removably on said rear end of said handle for retaining detachably said telescopic retriever in said receiving chamber; and a spring-loaded retaining unit mounted on said drive end of said shank and extendible radially into said axial bore of said shank so as to be adapted to retain removably the tool bit at said drive end of said shank.

2. The driving tool according to claim 1, wherein said spring-loaded retaining unit includes a radial retaining hole formed in said drive end of said shank, a ball member received in said retaining hole, and a resilient clasp sleeved on said drive end of said shank to urge said ball member to extend radially into said axial bore of said shank so as to be adapted to abut against the tool bit.

3. The driving tool according to claim 1, wherein said rear cap engages threadedly said rear end of said handle.

4. The driving tool according to claim 3, wherein said rear cap is formed with a recess which confronts said receiving chamber and which converges gradually and rearwardly, said telescopic retriever having a rear end extending into said recess and abutting against said rear cap so as to position said telescopic retriever in said receiving chamber.

5. The driving tool according to claim 1, wherein said telescopic retriever has a plurality of co-axial tube members connected to one another, said tube members including an innermost tube member and an outermost tube member, said axial bore of said shank having a cross-section larger than diameter of said innermost tube member and smaller than diameter of said outermost tube member such that said rear end of said shank abuts against one of said tube members of said telescopic retriever for retaining said telescopic retriever in said receiving chamber.

* * * * *